US007058988B1

(12) United States Patent
Zahner

(10) Patent No.: US 7,058,988 B1
(45) Date of Patent: Jun. 13, 2006

(54) APPARATUS FOR HANGING ARTICLES OF CLOTHING

(75) Inventor: David Zahner, New York, NY (US)

(73) Assignee: Zahner Design Group, Ltd., New York, NY (US)

( * ) Notice: Subject to any disclaimer, the term of this patent is extended or adjusted under 35 U.S.C. 154(b) by 329 days.

(21) Appl. No.: 09/916,603

(22) Filed: Jul. 27, 2001

Related U.S. Application Data

(63) Continuation of application No. 09/738,545, filed on Dec. 15, 2000, now abandoned, and a continuation-in-part of application No. 09/738,555, filed on Dec. 15, 2000, now abandoned, and a continuation-in-part of application No. 09/617,402, filed on Jul. 17, 2000, now Pat. No. 6,494,248.

(60) Provisional application No. 60/171,081, filed on Dec. 15, 1999, provisional application No. 60/203,873, filed on May 12, 2000, provisional application No. 60/143,853, filed on Jul. 15, 1999, provisional application No. 60/150,876, filed on Aug. 26, 1999, provisional application No. 60/217,747, filed on Jul. 12, 2000.

(51) Int. Cl.
*A41D 27/22* (2006.01)

(52) U.S. Cl. ..... 2/271

(58) Field of Classification Search ..... 160/330; 2/175.7, 271, 160
See application file for complete search history.

(56) References Cited

U.S. PATENT DOCUMENTS

| | | | | | |
|---|---|---|---|---|---|
| 554,066 | A | * | 2/1896 | Jager | 2/271 |
| 987,983 | A | * | 3/1911 | Harris | 24/342.1 |
| 1,193,891 | A | * | 8/1916 | Greene | 2/271 |
| 1,338,783 | A | * | 5/1920 | Lobar | 2/271 |
| 1,345,547 | A | * | 7/1920 | McDonald | 2/175.7 |
| 1,831,776 | A | * | 11/1931 | Nelson | 2/175.7 |
| 1,957,096 | A | * | 5/1934 | Connell | 2/175.7 |
| 1,990,278 | A | * | 2/1935 | Friedman | 2/115 |
| 2,434,430 | A | * | 1/1948 | Paulic | 2/271 |
| 2,634,422 | A | * | 4/1953 | Cantrell | 2/271 |
| 3,346,879 | A | * | 10/1967 | Buzzelli | 2/90 |
| 3,408,703 | A | * | 11/1968 | Brandenburg | 24/614 |
| 6,212,688 | B1 | * | 4/2001 | Leslie | 2/161.6 |

* cited by examiner

*Primary Examiner*—John J. Calvert
*Assistant Examiner*—J Smith
(74) *Attorney, Agent, or Firm*—Morris E. Cohen

(57) ABSTRACT

Accessories and methods for directly suspending clothing from a mounted rod. An opening is provided in the clothing, the opening communicating with an edge of the product and having both an open configuration and a closed configuration, with a supporting material such a loop fastener or a backing material integral with or attached to the clothing. The supporting material includes the opening and can be moved from the open to the closed configuration and back, allowing the product to be easily attached to and detached from a rod, hook, and so forth, without the need to use a hanger.

48 Claims, 10 Drawing Sheets

APPARATUS FOR HANGING ARTICLES OF CLOTHING

RELATED APPLICATIONS

The present application is a continuation of U.S. Nonprovisional application Ser. No. 09/738,545 filed Dec. 15, 2000 ("the '545 application") (abandoned), which claims the priority of U.S. Provisional Application Ser. No. 60/171,081 filed Dec. 15, 1999 ("the '081 application"), U.S. Provisional Application Ser. No. 60/203,873 filed May 12, 2000 ("the '873 application"), U.S. Provisional Application Ser. No. 60/143,853 filed Jul. 15, 1999 ("the '853 application), U.S. Provisional Application Ser. No. 60/150,876, filed Aug. 26, 1999 ("the '876 application"), and U.S. Provisional Application Ser. No. 60/217,747 filed Jul. 12, 2000 ("the Suspended Bath Products Application" or "the 747 application").

The present application is also a continuation-in-part of U.S. Nonprovisional application Ser. No. 09/617,402 filed Jul. 17, 2000 ("the External Slits application" or the "402 application") (patented as U.S. Pat. No. 6,494,248 B1 on Dec. 17, 2002).

The '545 application (U.S. Nonprovisional application Ser. No. 09/738,545 filed Dec. 15, 2000) is also a continuation-in-part of U.S. Nonprovisional application Ser. No. 09/738,555 filed Dec. 15, 2000 entitled "Towel Products" (abandoned).

The priority of all of the above applications is claimed, and all of those prior applications are fully incorporated into this application by reference.

FIELD OF THE INVENTION

The present invention relates to methods and apparatus for hanging articles of clothing.

BACKGROUND OF THE INVENTION

Currently, in the method widely utilized in the art, it is necessary to use a separate device such as a hanger to hang apparel or garments onto a fixed rod. By the term apparel, any and all types of apparel are contemplated herein, including, for example, coats, jackets, sweaters, shirts, pants, and so forth. In the present method, the consumer places an article of apparel onto a hanger and then places the hook of the hanger over the rod, thereby suspending the clothing. This procedure is an extremely well known method for storing clothing, particularly in closets, and is probably the most widespread means for storing clothing currently in use. It is an object of the present invention to provide methods and apparatus for hanging clothing which are improvements over the prior art.

SUMMARY OF THE INVENTION

It is an object of the present invention to provide methods and apparatus for hanging apparel onto supports such as rods.

It is a further object of the present invention to provide integrated or attachable and detachable devices for allowing the hanging of apparel onto rods without the need to use a separate hanger.

In accordance with the present invention, a variety of devices and methods are provided herein for directly suspending clothing from a support such as a fixed rod. The inventions can be used with any desired type of clothing, including, but not limited to, outerwear (e.g. jackets, coats, sweatshirts, etc.), shirts, pants, uniforms, bathrobes, pajamas, aprons, and so forth.

In the preferred embodiment, the support is a rod, e.g. such a clothing rod in a closet. Although the term "rod" is often used hereafter for simplicity as the preferred example of a support, it will be understood that the present invention can be used with any desired support, whether rods, bars, posts, sticks, shafts, protrusions, hooks, and so forth. The term particularly includes the closet rods, towel rods, oven bars, refrigerator door bars, and so forth which are common in the art. Yet, as a further advantage, the present inventions can also be used to hang objects onto hooks. Furthermore, the inventions can be hung onto a variety of other items, such as door handles, door knobs, fences, exercise equipment, and so on.

In accordance with the present invention, a variety of accessories and methods are provided for directly suspending clothing from a mounted rod. In various embodiments of the invention, an opening is provided in the product (e.g. a slit), the opening communicating with an edge of the product and having both an open configuration and a closed configuration. The open configuration of the opening is one in which the opening is sufficiently large such that the product can be inserted onto the rod through the opening. The closed configuration is one in which the opening is reduced in size, or blocked or sealed, such that the product hangs off of the rod without falling. Preferably, the opening is a slit and a hole, with the slit extending from the hole to the edge of the clothing.

In the preferred embodiments of the invention, a supporting material such a loop fastener or a backing material is integral with or attached to an article of clothing ("clothing item" or "product"). The supporting material includes the opening therein and can be moved from the open to the closed configuration and back, allowing the product to be easily attached to and detached from a rod, hook, or so forth. This supporting material or fastener allows the product to be hung from the rod (or hook or other mounted support) without removing the rod from its supports, while minimizing or eliminating the risk of the product falling onto the floor.

In a preferred embodiment, the supporting material is an integrated loop fastener with an external slit extending through the loop, and if desired through the material of the clothing item, as well. The fastener can be of any desired shape and size and is attached at any location on the product, but preferably is close to or overlapping one of the product's edges. The fastener can be integral with the product or attached thereto as a separate unit, whether permanently or on a removable basis. Although one fastener per product is preferred, multiple fasteners can be utilized if necessary or desirable.

The inventions, therefore, allow any item of apparel to be easily and securely hung on either a rod, a hook, or so forth, whatever is available. They allow the apparel to be hung onto a rod or a hook, even if no separate hanger is available. In one series of embodiments, the apparel includes a hook therein for suspending the apparel from the rod. In an alternate series of embodiments, an integrated loop fastener is provided to the clothing or a flap of the clothing for suspending the article of apparel.

Other embodiments, objects and advantages of the invention will become apparent in conjunction with the disclosure provided herein.

DETAILED DESCRIPTION OF THE INVENTIONS AND THE PREFERRED EMBODIMENTS

Figure 1:
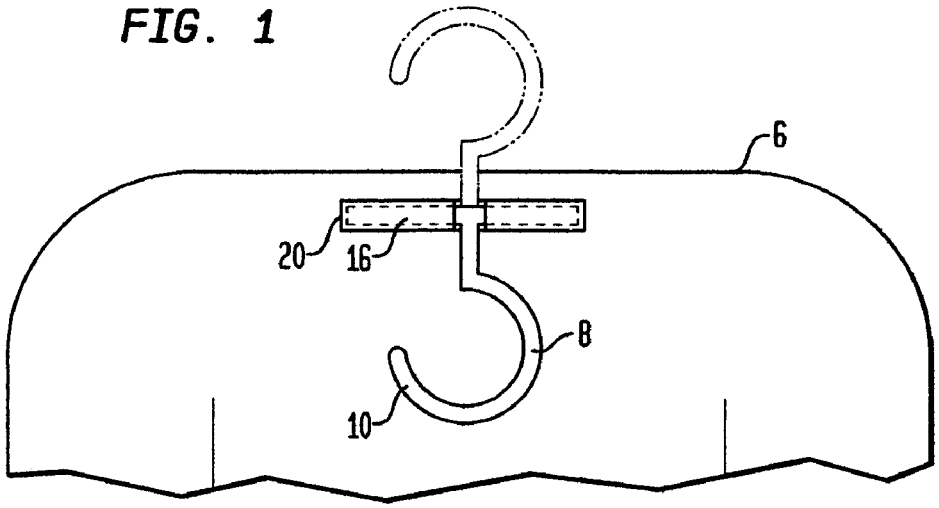
FIG. 1 is a front view of one embodiment of an apparel product with a hook extending therefrom in accordance with the present invention.

In accordance with the present invention, methods and devices are provided for directly suspending apparel from a fixed rod without the need for removing the rod from its supports, and without the need for an additional, external, device such as a hanger.

In contrast to the present invention, the current methods in the art require that a separate external device be provided in addition to the apparel for that apparel to be suspended from a rod. These methods are cumbersome in that retailers, consumers, and others must keep a stock of hangers on hand to suspend each article of apparel of interest on a longitudinal rod. If the user runs out of hangers or cannot find one, he or she is unable to suspend the desired article of clothing. Moreover, the small loops provided in the collars of some articles of apparel (e.g. coats) cannot be used to suspend the apparel on such a longitudinal rod except with great difficulty. To do so, at least one of the ends of the rod would have to be removed from its support so that the loop could be inserted on the rod, and removed again to remove the apparel. Accordingly, the method is extremely unwieldy and impractical. Furthermore, the loops provided are usually sufficiently small that they would not even fit over the common rods currently in use even in the unlikely event that the rods were removed from their supports.

In contrast, in accordance with the present invention, apparel fastening devices are provided which allow direct and easy suspension of the apparel onto a rod without removing the rod from its supports. Numerous of the embodiments (i.e. the loop fasteners) also allow the apparel to be hung onto a hook. In all of the embodiments of the invention, the apparel fastening devices are preferably integrated into the apparel so that the user is immediately able to suspend the apparel without the need to search for a separate suspension device.

In various embodiments of the invention, any of the inventions described in the applications listed above can be used to attach the clothing to a fixed rod and/or to a hook in accordance with the present invention.

In one such embodiment, a garment 36 with an integrated loop fastener 28 includes a vertical slit 30 as disclosed in the '853 application. In the embodiment shown, the loop fastener is a ring 28, with the vertical slit 30 being positioned on the garment so that it is at the top of the garment when the garment is suspended. Although the term "loop" or "ring" is used herein, it is to be understood, that the term is intended to include not only circular fasteners, but fasteners of any other shape as well. Likewise, although a "vertical slit" can be used, in alternate embodiments, a slit in another configuration can also be used, as shown in various of the embodiments disclosed below.

In a further embodiment of the invention, a configuration is used such as that in U.S. Pat. No. 5,186,232 issued on Feb. 16, 1993 ("the '232 patent"). Such a configuration requires at least one pair of rings, having a horizontal slit between each pair.

In the preferred embodiment, however, single rings with external slits are used as disclosed below. These latter embodiments take up less area on the apparel than a '232 ring configuration. In addition, since one fastener can be sufficient to hang a whole clothing, these embodiments use less fasteners per article of clothing, and are, therefore, less expensive to manufacture.

Figure 2:
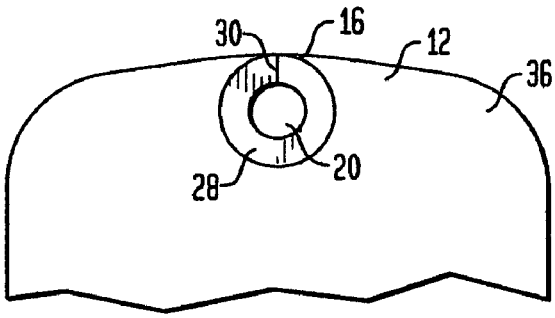
FIG. 2 is a front view of a second embodiment of an apparel product having a loop fastener attached thereto in accordance with the invention.

Accordingly, in a preferred embodiment of the present invention, apparel 36 includes an integrated loop fastener 28 which includes an slit 30. An example of such an embodiment is shown in FIG. 2. The integrated loop fastener or ring 28 with slit 30 can be positioned in any of various locations on the clothing, the external slit 30 being located so as to intersect with an edge of the clothing 36 (preferably an upper edge, i.e. an edge which is on top when the clothing is held in the desired position for hanging), and so as to communicate with the environment external to the clothing. This allows the ring 28 to be attached over a rod 40, without removing the rod 40 from its supports.

Figure 4:
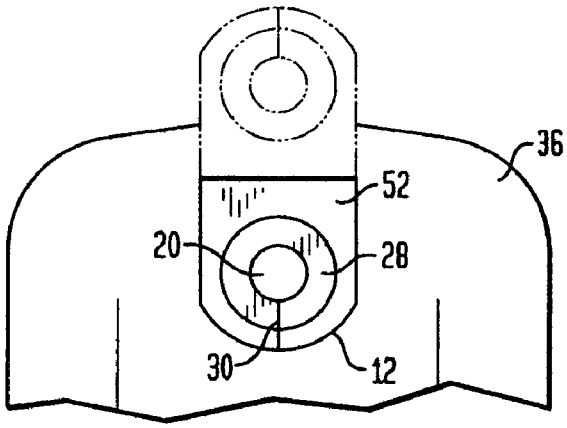
FIG. 4 is a front view of a further embodiment of a product of the present invention, having the fastener attached to a flap on the article of apparel or clothing.

Ring or fastener 28 can be in any desired position on or attached to the clothing. Preferably, as shown in the embodiments shown in FIG. 2, the ring is close to an upper edge of the clothing. Alternatively, the ring may be in any other desired position, e.g. on the back of a jacket as shown in FIG. 4, but is also preferably relatively near the clothing's top edge. For example, as shown in FIG. 4, the fastener can be located in the center of one of the product's edges.

Figure 3:
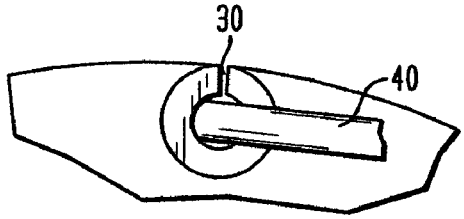
FIG. 3 is a perspective view of the embodiment of FIG. 2 after insertion onto a rod in accordance with the method of the present invention.
Figure 5:
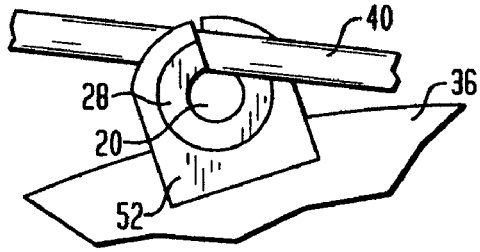
FIG. 5 is a perspective view of the embodiment of FIG. 4 as it is inserted onto a mounted rod.

To attach the ring, the ring 28 is flexed slightly and inserted over the rod 40 as shown in FIGS. 3 and 5. This allows the clothing to be easily attached onto the rod whenever desired. The clothing can be easily removed from the rod by reversing the process. In this manner, the clothing is securely yet removably attached to the rod. Even if the clothing is pulled with moderate pressure, it will not fall off the rod and onto the ground.

In a further embodiment of the invention, the integrated loop fastener 28 is attached to a flap 52 in the clothing item 36 as shown in FIGS. 4 and 5. As shown therein, clothing item 36 is provided with a flap 52 that includes an integrated loop fastener 28 having an external slit 30. The flap 52 can be permanently affixed to the clothing, e.g. by sewing, or by forming a clothing item in one integral piece with a flap extending therefrom. Or, the flap can be removably attached to the clothing, e.g. by buttons, or velcro, or so forth. If desired, flap 52 can be folded over if the clothing is folded for placement on a shelf.

As shown in FIG. 4, the integrated loop fastener 28 can be located with the outer edge of the fastener spaced from the edge of the clothing item 36, and with the external slit extending from the clothing item to an edge 12 of the product. In those embodiments, the external slit 30 extends from the open interior or hole 20 of the integrated loop fastener, through the fastener, then through the material of the clothing (either the clothing itself or the clothing flap 52), until the slit 30 exits at an edge 12 of the product.

In accordance with the invention, the product with the fastener can also be hung off of a hook, if desired, by inserting the open interior or hole 20 of the loop fastener over an end of the hook. Thus the same fastener can be used to hang the product off of a rod or a hook.

In alternate embodiments of the invention, the integrated loop fastener 28 can be placed so that an edge 16 of the fastener 28 touches the edge 12 of the clothing 36 as shown in FIG. 2. In this alternate embodiment, the slit 30 extends from the open interior 20 of the fastener through the fastener to exit directly at the edge 12 of the clothing.

Any of the configurations and embodiments of integrated loop fasteners or rings of the '232 patent and the applications cited above, or any of the construction techniques therein for making or manufacturing the rings, can be used in accordance with the present invention.

Thus, in accordance with the invention, an apparatus is provided which allows clothing ("a product") to be attached to a mounting rod or a hook. The apparatus consists of a supporting material integral with the clothing, or attached or attachable to the clothing, with the supporting material having an opening such as a slit provided therein. Preferably, the supporting material is in the form of a fastener or ring. In accordance with the invention, the slit can be of any shape or size desired, whether straight, curved, or so forth. Likewise it can be of any width desired, whether a uniform width, or a width which changes over the length of the slit, e.g. in an hourglass shape.

In the preferred embodiment, the supporting material has rigidity sufficient to support the clothing on a rod or hook. Preferably, it also has sufficient elasticity or flexibility to allow the slit to be enlarged or flexed open until it is large enough to insert it over a rod. Further preferably, it has memory so that the ring will return to the original size of the slit when released, preventing the rod from falling through the slit. For example, the supporting material can be made of homo polypropylene, ABS, or other suitable materials. These materials are strong enough to support the various fabrics commonly used for the products of the invention. In addition, they also have excellent memory so that, after being flexed to fit over the rod, the ring automatically springs back to its original position. Thus, the ring can be bent or flexed when force is applied by the user, with the ring returning to its original position when the force is removed, and having sufficient rigidity and structural strength such that it can support the weight of the product when the ring is used to suspend the product on a rod.

As disclosed in the '232 patent, pairs of rings can be provided having a horizontal slit connecting each pair. In an alternate embodiment, the clothing includes at least one external slit therein. By external slit, the present application refers to a slit which passes through the material of the clothing (and through a ring as well if one is provided) to ultimately exit outside the clothing.

Using an external slit, the external slit in the fastener and/or product can be at any orientation with respect to the plane or surface of the product. In one embodiment, an external slit can be used to hang the product at an approximately 90 degree angle to the bar, e.g. by providing a fastener with an external slit, wherein the fastener is located in or on the plane of the product or parallel thereto. Alternatively, an external slit can be used to hang the clothing flat along the bar, by providing the fastener or external slit at an angle to the plane of the product. This is accomplished for example, by using an embodiment of fastener which attaches with a tab, or by using a rotating fastener. Alternatively, the fastener can be provided at any other angle to the plane of the product desired or necessary for a given use.

The external slit can also be in any angular orientation in the fastener and/or product, whether horizontal, vertical, or at any other angle. For example, when used in conjunction with a ring, the slit can extend through any position on the ring, whether the "12 o'clock" position, or to 1 o'clock, 2 o'clock, 10 o'clock, 11 o'clock, or so forth. Any combination of external slits, rings, and '232 configuration rings can be provided. For example, rings with external slits can be provided to the clothing in addition to the horizontally slit rings of the '232 patent. Alternatively, the clothing can be provided with externally slit rings only. Preferably, one ring with an external slit is provided to maximize the number of garments which can hang on a rod.

Figure 6:
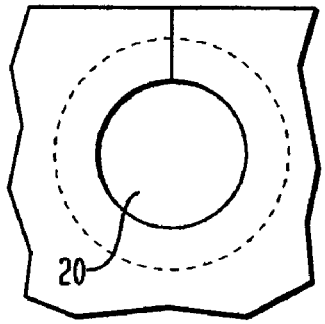
FIG. 6 is a front view of a loop fastener inserted into a product of the present invention.

In one embodiment, as shown for example in FIG. 6, the ring is located within the area of the clothing ("the hanging product") and the external slit extends from the ring and through the clothing, exiting at the clothing's edge. In other words, a space of exists between the ring and the edge of the clothing, and the external slit extends through that space. The ring, as with the other rings or fasteners of the present invention, can be attached to the hanging product via any desired secure means. For example, the rings can be attached by staking, by sealing, by sewing, by welding, or by using any of the methods disclosed in U.S. Provisional Application Ser. No. 60/150,876, filed Aug. 26, 1999, whose contents are fully incorporated herein by reference.

In the embodiment shown in FIG. 6, a closed ring is provided. The term closed ring refers to the fact that the external slit is normally "closed"—i.e. the two radial edges which form the slit are pressed together. In this embodiment, the ring has some degree of flexibility, and must be flexed for the slit to open, i.e. for the edges of the slit to move some distance apart. Flexing the ring increases the width of the gap to insert the ring over the rod. The slit extends through the ring until the edge of the hanging product (whether that edge of the hanging product is beyond the edge of the ring or coincides with it as shown in various embodiments below).

Figure 23:
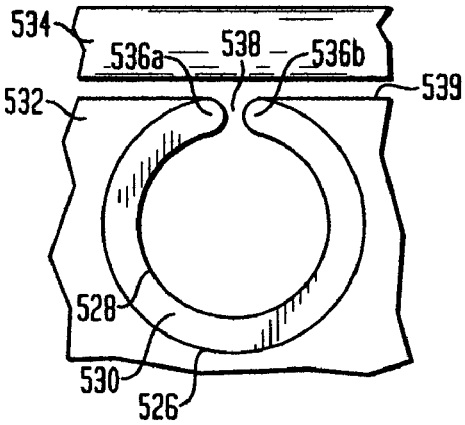
FIG. 23 is a front view of a further embodiment of a product of the present invention having an open loop fastener attached thereto as it is being inserted onto a rod.

In an alternate or additional embodiment of the invention, as shown in FIG. 23, an open ring 530 is provided in the material 532 of the clothing for attachment of the clothing to the rod or bar 534. In accordance with this embodiment, ring 530 is an open ring which is provided with rounded edges 536. A space is provided between the edges of the open ring, forming a mouth or gap 538 which acts as the external slit. Preferably, the gap is approximately 1/16" to 1/8" in diameter, although larger or smaller gaps can be used, depending on the application, rod size, and shape. Further preferably, the upper edge of ring 530 is tangent to the upper edge 539 of suspended material 532.

In this embodiment, rounded edges 536 and mouth 538 form an external slit design which is easy for a person to attach to rod 534. The difference between an open ring and a closed ring can be seen by contrasting the embodiment of FIG. 23 with the embodiment shown in FIG. 6. In the embodiment of FIG. 6, a closed ring is provided having a radial slit therethrough. The ring is closed in that the slit consists of a right radial edge and a left radial edge of the ring, those right and left radial edges being pressed against each other. In contrast, the embodiment of FIG. 23 provides an open ring structure in which a gap exists between the left radial edge 536*a* of the ring and the right radial edge 536*b* of the ring, radial edges 536*a* and 536*b* being the edges extending from the outer circumference or outer edge 526 to the inner circumference or inner edge 528 of the fastener or ring.

Furthermore, it is preferred that the radial edges of the open ring be rounded as shown in FIG. 23. Open mouth 538 and rounded edges 536 facilitate the attachment of the ring to the rod from below, and further facilitate the attachment of the ring with one hand. These features are of general advantage to all users, and are of particular advantage to individuals who may be short, to children, to the handicapped, and to those who might have trouble opening the ring due to problems such as arthritis.

The ring or fastener of the invention can be of any desired shape. For example, it can be rounded, oval (e.g. an ellipse which is elongated along the vertical or horizontal axis), or so forth. An elongated oval shaped rod can facilitate attachment of the ring to a square or rectangular rod. The ring 530 can include an open mouth (i.e. a gap between the slits), as in the embodiment of FIG. 23, or, alternatively, it can have a closed mouth, such as shown in FIG. 6. The ring can also have the edge of the ring tangent to the edge of the clothing, as shown in FIG. 2. As an alternative to the use of an oval, which is preferred, the elongated ring can be any non-circular shape, including, for example, a rectangle or quadrilateral. Moreover, the external and/or internal edges of the ring need not be rounded although they are preferably so.

Figure 7:
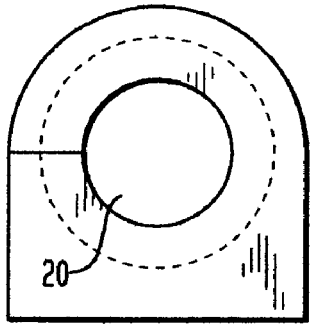
FIG. 7 is a front view of a loop fastener inserted into a flap extending from a product of the present invention.

In one embodiment of the present invention, the ring wholly overlaps with the material of the clothing, whether being a distance from the edge of the clothing or touching the edge of the clothing. The ring can be directly affixed onto the material of the clothing. Or, it can be located within the clothing, for example, inserted between two layers of material as shown in FIGS. 6 and 7. Likewise, for the embodiments in which the fastener is on a flap, the ring can also be affixed to the flap, or it can be located within the flap between layers of material, as shown in FIG. 7.

Figure 15:
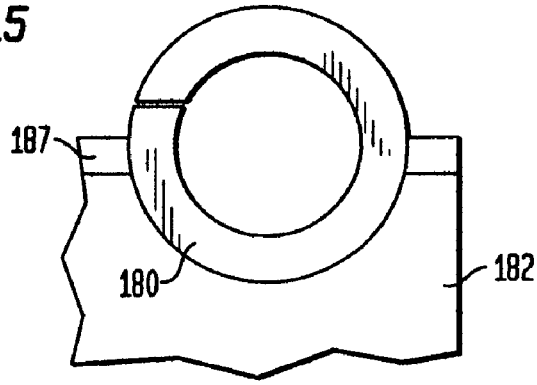
FIG. 15 is a front view of a loop fastener with an offset horizontal slit attached to a clothing item in accordance with the present invention.
Figure 16:
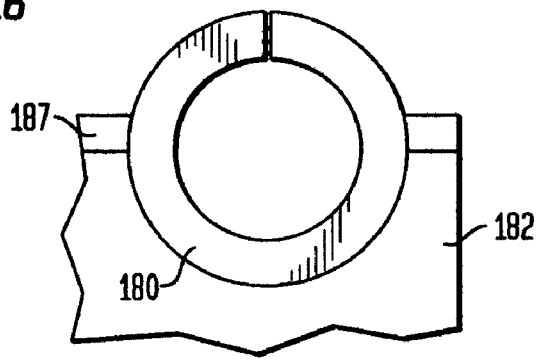
FIG. 16 is a front view of a further embodiment of a loop fastener with a vertical slit attached to a clothing item in accordance with the present invention.

In alternate embodiments, as shown in FIGS. 15 and 16, ring 180 overlaps with the edge of the clothing 182, such that ring extends beyond hem 187. The slit in the ring can be in any desired orientation, whether horizontal as in FIG. 15, or vertical as in FIG. 16.

Figure 8:
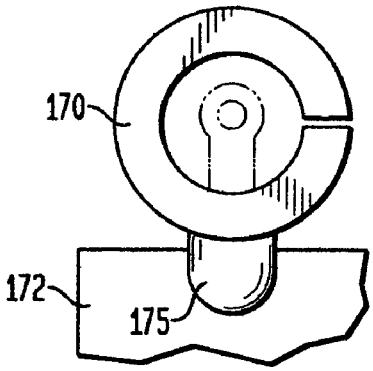
FIG. 8 is a front view of a loop fastener attached via a tab to a clothing item in accordance with the invention.
Figure 9:
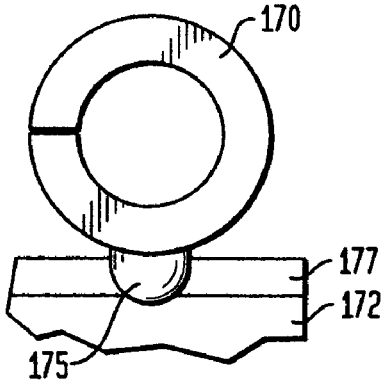
FIG. 9 is a front view of a integrated loop fastener inserted via a tab to a clothing item.

In yet a further embodiment, a tab 175 can be placed at the bottom of a ring 170 (either horizontally slit as shown, or any other slit configuration of slit). Tab 175 is used to attach the ring to a clothing 172 as shown for example in FIGS. 8–10. The tab can be secured to the hem 177 of the product, as shown in FIG. 9, or can be attached directly to the product as shown in FIG. 8. In one embodiment, one of the tabs folds down 180 degrees as shown in FIG. 8 (or both do), to ease attachment of the tab to the product. Alternatively, the tab can open to a lesser angle, such as the angle shown in FIG. 10.

Figure 18:
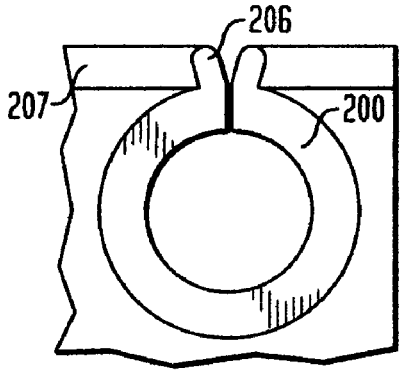
FIG. 18 is a front view of a product of the present invention having a loop fastener with a finger or extension extending therefrom.
Figure 19:
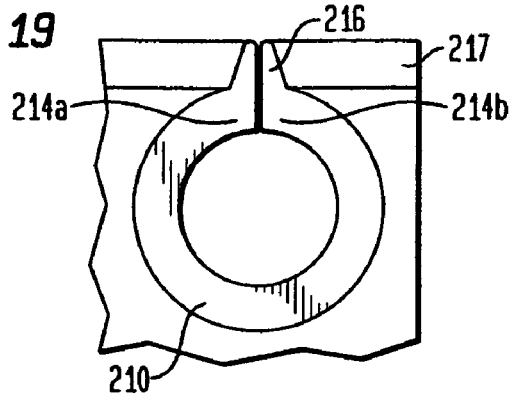
FIG. 19 is a front view of a further embodiment of a product of the present invention having a loop fastener with a finger or extension extending therefrom.

The fasteners can have a horizontal slit as shown in FIGS. 8 and 9 or can have a vertical slit provided through the ring as shown in FIGS. 18 and 19. When a tab is provided, the tabs can be used to attach an integrated loop fastener to the top of a preexisting item though an existing hole in that item.

Figure 10:
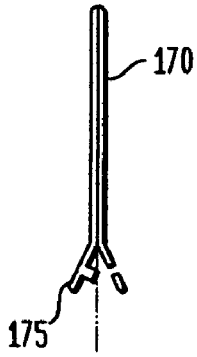
FIG. 10 is a side view of the embodiments of FIGS. 8 and 9.

For example, each tab could attach to a hole punched through the product during manufacture. Alternatively, the tabs could include a pointed pin to pierce a material which does not have existing holes. These embodiments, therefore, can be used to convert existing items into items having integrated loop fasteners. In a preferred embodiment, the tabs include an attachment pin and opening for that pin, with the pin being inserted into the opening as shown in FIG. 10.

When a tab is used, the plane of the fastener can be provided along or parallel to the plane of the surface of the product as shown in FIG. 8. Alternatively, the tab can be flush or parallel to the plane of the product, while the fastener is at an angle to the tab, whether 90 degrees or otherwise. This embodiment can be used to determine the angle that the product makes to the rod when it hangs along the rod, as further discussed below.

Any desired fabric material can be used for the product of the present invention. For example, the fabric material can be vinyl, cotton, polyester, polyester/cotton or any other natural or synthetic fabric, including woven or non-woven fabrics. Generally, the material is relatively soft.

In one embodiment of the invention, two half rings are placed together to encapsulate the fabric material therein. In an alternate embodiment, a single ring is integrated into the fabric material.

Figure 17:
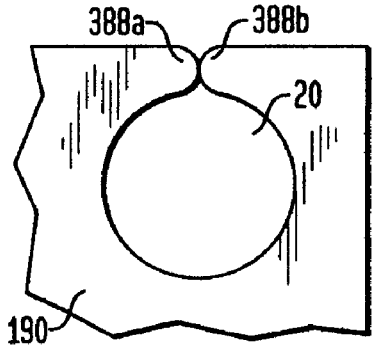
FIG. 17 is a front view of a product of the present invention in accordance with a further embodiment, with a rigid or semirigid insert or backing.
Figure 21:
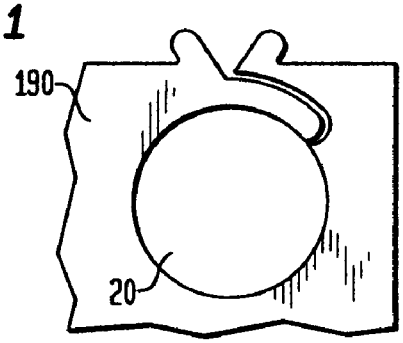
FIG. 21 is a front view of a product of the present invention in accordance with a further embodiment having a rigid or semirigid insert or backing.
Figure 24:
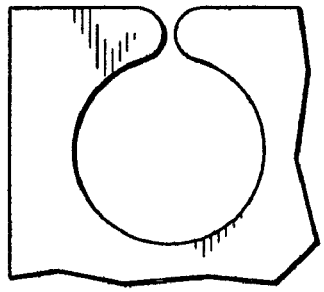
FIG. 24 is a front view of a product of the present invention in accordance with a further embodiment having a rigid or semirigid insert or backing.

Further embodiments are shown in FIGS. 17, 21 and 24. These embodiments can be cut directly into the material, e.g. with a backing of some supporting material 190 behind it, or can be inserted into the material (e.g. between two layers). In either case, the material of the embodiment is preferably relatively rigid or semi-rigid such as a thick vinyl. The external slit used can be a simple closed slit, as in FIG. 6. Alternatively, it can be a more rounded design such as shown in FIG. 17. An open slit (i.e. one with a gap between the left and right radial edges) with rounded edges can also be used, as in FIG. 24. Furthermore, the edges of the slit can be rounded in any of the embodiments of the invention, as shown for example in FIGS. 17, 21 and 24.

Figure 20:
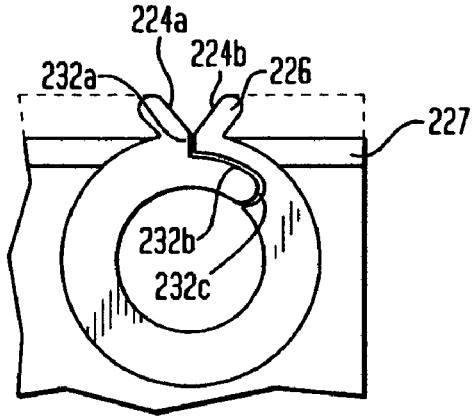
FIG. 20 is a front view of yet a further embodiment of a product of the present invention having a loop fastener with a finger or extension extending therefrom.

A projection, extension or finger can also be provided to the ring as shown in FIGS. 18–20. As illustrated in the figures, in further embodiments of the invention, a ring 200, 210 or 220 is provided with a projecting edge, flange, extension, or finger 206, 216 or 226. Extensions 206, 216 or 226 are projections off of the ring (preferably off of the ring's outer circumference), which extend beyond the ring away from the hanging product (i.e. toward the ceiling). The extensions are each located adjacent to and to the side of the slit. Preferably two extensions are provided, one on each side of the slit.

These extensions serve numerous functions. For example, they make it easier to open up the slit when flexing the ring. Extension 206 or 216 of FIGS. 18 and 19, for example, are provided to overlap hems 207 and 217, respectively, supporting the hems of the clothing and preventing it from drooping when the clothing is hung on the rod. Fingers 206 and 216 also cover the cut vertical edge of the hem, preventing it from fraying. Finger 226, on the other hand, is provided beyond the hem 227, with the ring 220 overlapping the hem to support it. In this embodiment, a portion of the ring, the finger only, projects beyond the edge of the clothing.

In a further additional design, the fingers can be spread and opposed as shown in FIGS. 18 and 20. As shown in FIG. 20, for example, fingers 226 can be provided as opposed "thumbs". In other words, inner edges 224*a* and 224*b* are at an angle to each other greater than 0 (zero) degrees but less than 180 degrees. This is in contrast to the inner edges 214*a* and 214*b* of the fingers of FIG. 19, which are parallel to each other. These spread fingers facilitate attachment of the rings 200 and 220 to a rod. They make it easier to slide the ring into the rod until the ring is pushed over the rod. They also make it easier to spread the ring open by hand to insert it over the rod. They can be used with a straight slit slit through the ring, or with a rounded or curved slit.

As an alternative to a straight external slit, a curved external slit 232 can be provided as shown in FIG. 20. In one embodiment, curved slit 232 has a first vertical component 232*a*, a second approximately horizontal component 232*b*, and a radial component 232*c*. Radial component 232*c* of slit 232 exits the inner circumference of the ring at a location which is offset to the side, rather than exiting the ring at the top of the inner circumference of ring 220 (i.e. rather than exiting directly below vertical component 232*a*). In this embodiment, fingers 224*a* and 224*b* are pulled to the left and right, respectively to open up the ring 220 and insert the ring over a rod. Curved slit 232, which intersects the inner circumference of the ring at an offset position rather than at the top of the ring, provides an advantage to the user in that the slit 232 will not sit directly on top of the rod while the clothing is hanging or is in use. This eliminates the problem of the slit riding on the rod when the clothing is pulled. Instead, a smooth surface of the ring rides on the rod, easing movement of the clothing on the rod. The various features of the embodiment of FIG. 20 can also be provided directly to the clothing without using a ring but by using a rigid or semirigid backing positioned on the clothing (e.g. at a corner) as shown in FIG. 21.

In addition, the fingers or projections can extend past the hem as shown by the solid lines in FIG. 20. Alternatively, they can be located on the hem, as shown for example, by the dotted outline in FIG. 20, which shows the fingers extending up to the edge of the clothing.

Figure 22:
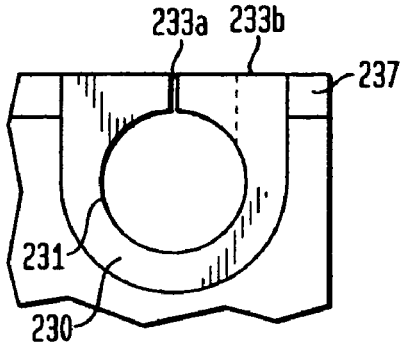
FIG. 22 is a front view of a further embodiment of a product of the present invention having a loop fastener attached thereto.

In a further embodiment, the ring 230 can be provided with a flat upper edge 235, as shown in FIG. 22. Upper edge 235 overlaps with hem 237. Upper edge 235, therefore, provides yet further support for the hem over an extended length of fabric. Using the embodiment of FIG. 21, upper edge 235 provides support over a length equal to approximately the outer diameter of the ring 230 for each ring. This upper edge can be the entire upper edge of the ring, and if desired can be used in conjunction with any of the extensions or fingers of FIGS. 18–20.

Instead of a vertical external slit 233*a* which is central, an offset slit 233*b* can be provided to any of the embodiments of the invention, as shown, for example, by the dotted line in FIG. 22. Offset slit 233*b* is a slit which intersects the inner circle 231 in a secant-like or tangent-like fashion. In other words, offset slit 233*b* is off center, such that the line it makes (if extended) would not intersect the center of inner circle 231. This offset slit allows the ring to glide more smoothly along the rod since the slit does not sit directly on top of the rod.

Figure 11:
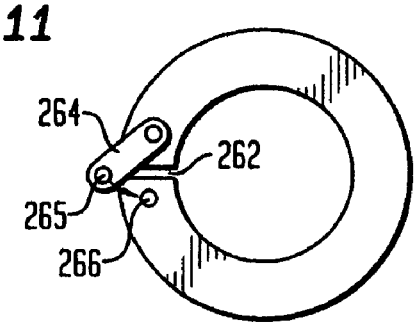
FIG. 11 is a front view of an embodiment of a loop fastener with a closure element for a product of the present invention.
Figure 12:
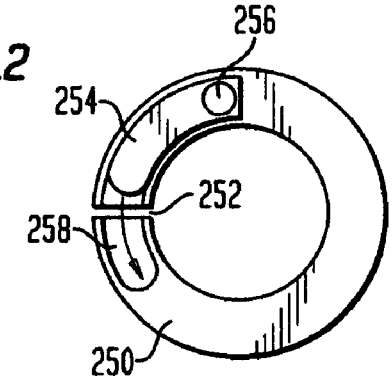
FIG. 12 is a front view of a further embodiment of a loop fastener with a closure element for a product of the present invention.
Figure 13:
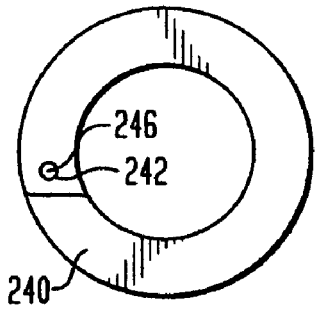
FIG. 13 is a front view of a further embodiment of a loop fastener with a closure element for a product of the present invention.
Figure 14:
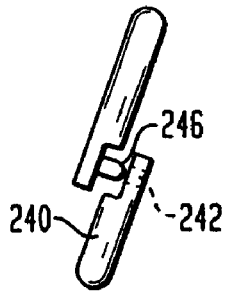
FIG. 14 is a side view of the embodiment of FIG. 13.

In further embodiments of the invention, a ring is provided which can be selectively opened or sealed, i.e. "locked" as shown in FIGS. 11–14. FIG. 13 is a front view of ring 240 and FIG. 14 is a side view of the ring 240 as it is being locked. Ring 240 includes a pin 246 which extends through a opening or channel 242. In the open position, shown in FIG. 14, the pin 246 is separated from channel 242, forming a gap for placing the ring on a rod. In the closed position, pin 246 inserts snugly into channel 242 to seal the ring.

In further embodiments of the invention, a ring 250 is provided, as shown in FIG. 12. Ring 250 includes an internal sliding member 254 which can be pushed or pulled using knob 256. Sliding member 254 slides into and out of internal channel 258 to close and open gap 252. In an alternative embodiment, shown in FIG. 11, a pivoting member 264 is provided, having a pin 265 which inserts into an opening 266. Pivoting member 264 can be rotated to open or close gap 262. Alternatively, the gap can be closed by straps which utilize snaps, velcro or other attachment devices.

In general, the embodiments of FIGS. 11–13 are useful for providing a very secure ring which cannot accidentally be pulled off of a rod. They also increase the smoothness of the sliding of the rings along the rod. If desired, they can be made with rigid or semi-rigid materials for the fastener. Or, they can be made with soft materials. For example a soft fastener can be used for the embodiment of FIG. 11, with a strap being provided in place of the pivoting member 264, wherein the strap secured to a mating element 265.

In a further embodiment of the invention, a tape or strip may be provided having any of the embodiments of the rings shown herein. Such a strip can be used to convert an existing item of clothing into one of the present invention, or can be used to provide a hanging product in which the specific types of fasteners provided on top can be interchanged. The strip includes attachment devices which attach to a portion of the clothing.

For example, in one embodiment, a blank or template of material can be provided which has a cutout of material shaped like a pair of rings, each pair being connected by a strip of material including a horizontal slit as in the '232 patent. This blank or template can then be attached to a preexisting item using tabs on the bottom blank as previously discussed with respect to the rings of FIGS. 8–10, or using adhesive, or any other desired attachment means.

Likewise, in an alternate embodiment, a tape can be used, wherein the tape has fasteners therein. The tape is a strip of material which includes a pattern of any embodiment or combination of embodiments of the loop disclosed above. The tape further includes an attachment element for attaching the tape to a desired material. In one embodiment, the attachment element is a tab. In other embodiments, the attachment element is adhesive, or so forth.

Figure 29:
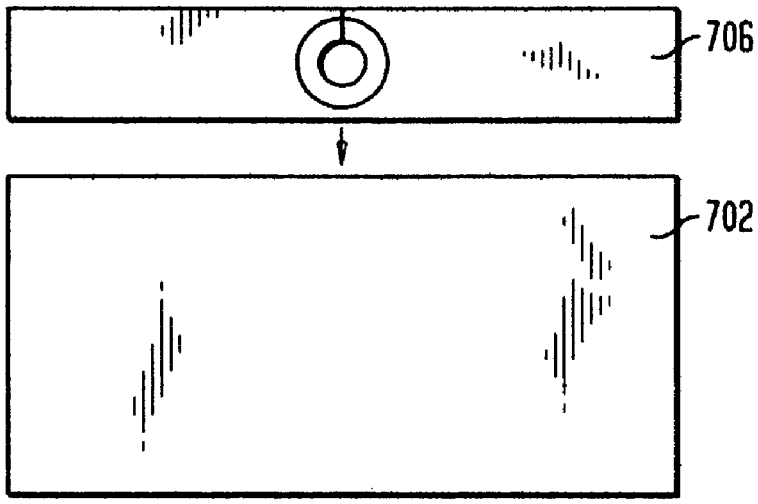
FIG. 29 is a front view of a strip having a loop fastener therein, for attachment to a product in accordance with the present invention.

An example of such embodiments of the invention is shown in FIG. 29. Strip 706 can be used to convert an existing clothing item 702 into one of the present invention, or can be used to provide a clothing item in which the specific types of fasteners or provided on top can be interchanged. Strip 706 includes attachment devices on the bottom of the strip which attach to the top of the clothing item 702. The attachment devices can be reversibly detachable, e.g. via snaps, a button and hole type design, a zipper, or a hook, or can be more permanent, e.g. via sewing, welding, adhesive, or so forth. Any other attachment methods for attaching the strip to the hanging product can be used as well. For example, tabs such as tabs 175 in FIGS. 8 and 9 can be affixed to the bottom of strip 706 to attach the strip to a product. In one embodiment, an existing hanging product with holes can easily be converted to one of the present invention by attaching the strip 706 to the hanging product using the holes. As with the other hanging products of the present invention, the hanging product 702 can be woven, non-woven, rigid, semi-rigid, or so forth.

Further in accordance with the invention, the embodiments can be placed in sequence from right to left along a rod. This allows a person to cover a rod with a large number of clothing items.

Figure 25:
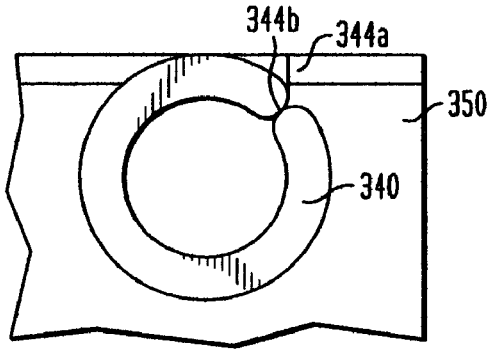
FIG. 25 is a front view of a further embodiment of a product of the present invention having a loop fastener attached thereto, wherein the slit through the product is at an angle to the slit or opening through the fastener.

As shown in FIG. 25, the slit 344 can include a segment or slit 344*a* which extends through the clothing 350, and a segment or slit 344*b* which extends through the ring 340. As previously discussed with respect to FIG. 20, the slit 344 need not be in a straight line. As shown in FIG. 25, slit 344*a* is at an angle to slit 344*b*, the angle being other than 180 degrees. If desired, the slits 344*a* and 344*b* can combine to form a curved slit, or can be two straight segments at any angle to each other, the latter being shown in FIG. 25.

Figure 26:
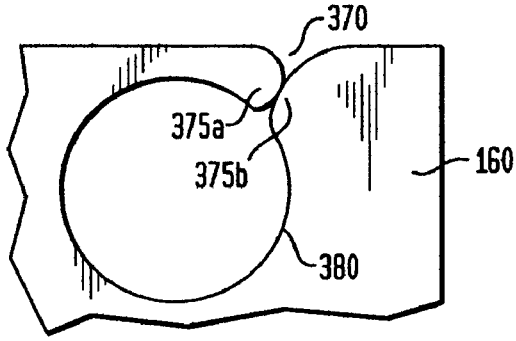
FIG. 26 is a front view of a product of the present invention in accordance with a further embodiment having a rigid or semirigid insert or backing.

As shown in FIG. 26, in a further preferred embodiment the clothing includes an inner cut-out area 380 and is reinforced with a rigid or semi-rigid backing in this area. The clothing product includes a slit 370 which extends from the edge of the hanging product to the inner cut-out area 380. Slit 370 includes a left radial edge 375*a* and a right radial edge 375*b*. Preferably, the slit is an offset slit. Further preferably, the radius of the left radial edge 375*a* is different than the radius of the right radial edge 375*b*. FIG. 26(*a*) can therefore be contrasted with FIG. 17 which shows an embodiment in which the left and right radial edges 388*a* and 388*b* are of equal radii, and wherein the slit is not offset but central, along the radius of the circle. In the embodiment of FIG. 26(*a*) it is also preferred that the left radial edge and right radial edge contact each other, although a gap can alternately be provided.

Figure 27:
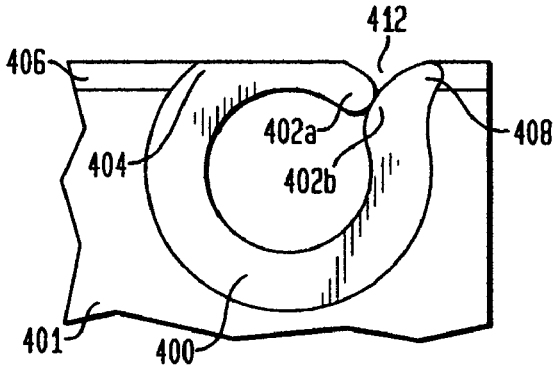
FIG. 27 is a front view of a loop fastener attached to a product of the present invention.

A clothing can also have a ring designed in this fashion, as shown in FIG. 27. Ring 400 is provided as part of clothing or hanging product 401. Ring 400 includes a slit 412. Slit 412 (and likewise ring 400) has a left radial edge 402*a* and a right radial edge 402*b*, wherein left radial edge 402*a* and right radial edge 402*b* have different radii. The ring 400 includes an edge 404 which is flat along at least a portion of the upper edge of the ring and preferably overlaps hem 406. Extension 408 off of the ring 400 further serves to make it easier to open the ring and facilitates its attachment onto a rod, and also serves to support the hem 406.

Further in accordance with the invention, any of the embodiments herein can be used to hang the product with the fastener off of a rod or a hook. Any embodiment can be hung off of a hook, by providing an open interior 20 to the embodiment. The clothing or fastener is then hung over the hook by inserting the open interior 20 (such as a hole) over an end of the hook. Thus the product can suspended from a rod by opening up and closing the slit, or can be suspended off of a hook by inserting the hook through the open interior.

Figure 30A:
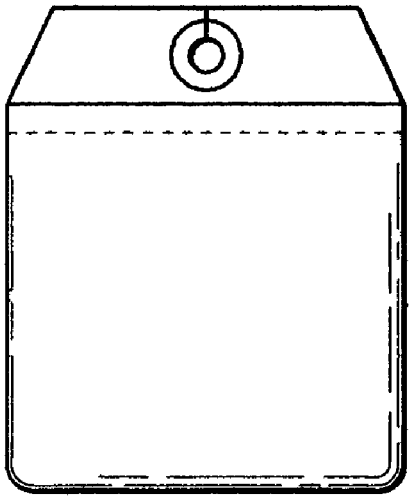
FIG. 30(*a*) is a potholder and FIG. 30(*b*) is an oven mitt in accordance with the invention.
Figure 30B:
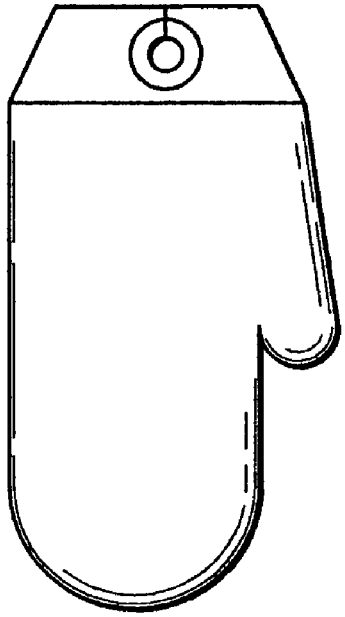
Figure 31:
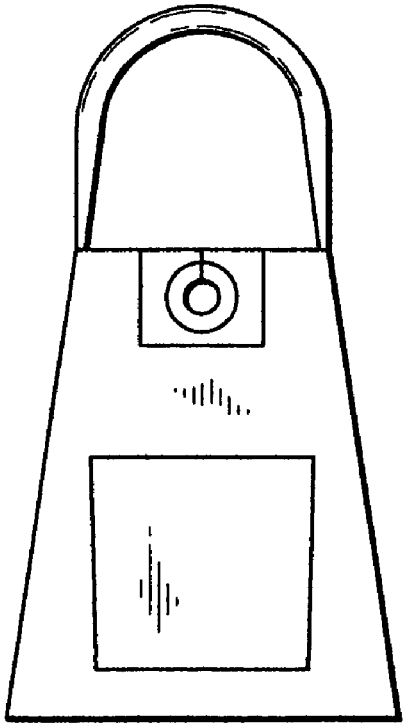
FIG. 31 is an apron in accordance with the invention.

Any of the embodiments of the present invention can be used with any clothing item. Such products include traditional clothing items such as jackets, outerwear, and so forth, and can also include potholders, as shown in FIG. 30(*a*), oven mitts, as shown in FIG. 30(*b*), and aprons, as shown in FIG. 31.

Figure 32:
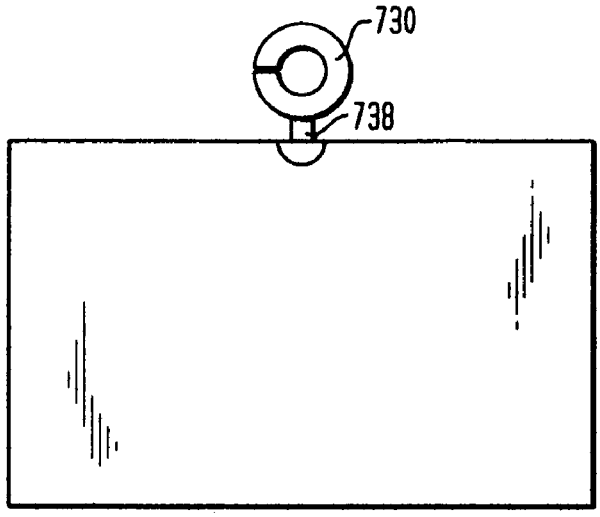
FIG. 32 is a front view of a rotating fastener in accordance with the invention.

In a further embodiment of the invention, a rotating fastener or ring is utilized for placement of the product on a rod, without removing the rod from its supports, as shown in FIGS. 32–25. Ring 730 is mounted on a pivoting member 738, as shown in FIG. 32. This pivoting member allows the ring to rotate so that the clothing can be suspended at the desired angle with the shower rod. Alternatively, the ring 740 can be fastened onto to the clothing at fixed angle.

Figure 33:
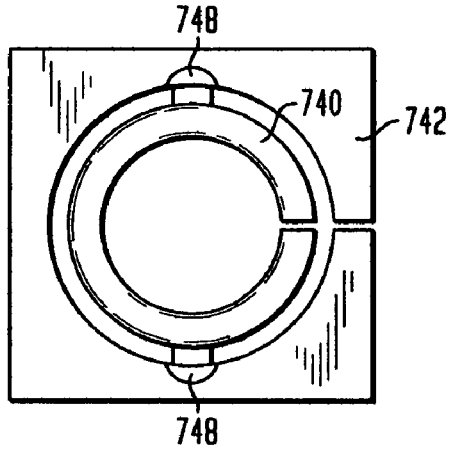
FIG. 33 is a front view of a further embodiment of a rotating fastener in accordance with the invention, the rotating fastener being in a first configuration.
Figure 34:
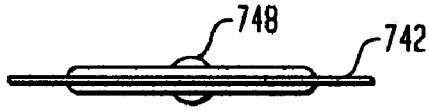
FIG. 34 is a top view of the rotating fastener of FIG. 33 in a first configuration.
Figure 35:
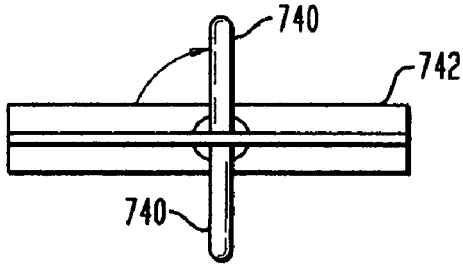
FIG. 35 is a top view of the rotating fastener of FIG. 33 in a second configuration after rotation.

A further embodiment of the rotating ring is shown in FIG. 33. Preferably, the ring 740 is mounted in an outer frame 742, with the pivots 748 extending from that frame to the ring 740. In the initial position, the ring is flat in the frame 742 (with the frame 742 being flush with the product) as shown in FIG. 34. The ring can rotate on the pivots 748 to a position where it is perpendicular with the frame 742 and the surface of the product as shown in FIG. 35. This embodiment allows the position of the clothing to be rotated while it is hanging on the rod, to ease drying of the hands.

In a further series of embodiments of the present invention, the article of apparel includes a hook for affixing the apparel to the rod. Preferably, this hook is permanently attached to the clothing item, although it can be made removable in alternative embodiments. In a preferred embodiment, the hook can rotate from a lower position overlapping the garment (the position the hook is kept in when it is not being used to hang the garment), to an upper position wherein the hook extends from the garment in a configuration which allows the garment to hang from a bar.

In one such embodiment, an integral apparel hook is provided as shown in FIG. 1. Integral apparel hook 8 includes a hook end 10 which is attached to a bar 16. Any shape hook can be provided, whether rounded, curved, rectangular or so forth. Bar 16 is preferably attached to the apparel 6 such that the bar can rotate. In the preferred embodiment, hook 8 is made of a thin comfortable material such that it can rest against the user's skin if desired. Any material can be used for the hook (or the other fasteners of the present invention) so long as the material is, of course, of sufficient rigidity and strength such that it can suspend the article of clothing that it is attached to. In the system shown, bar 16 is inserted into a pocket 20, while allowing the bar free movement within the pocket. While the user is wearing the garment, the hook is normally in the lower or "upside down" position. Rotation of the bar in the pocket moves the bar from that lower position, to the upper or "right side up" position (shown in dotted outline), which is the position used to hang the garment on a longitudinal rod.

Figure 36:
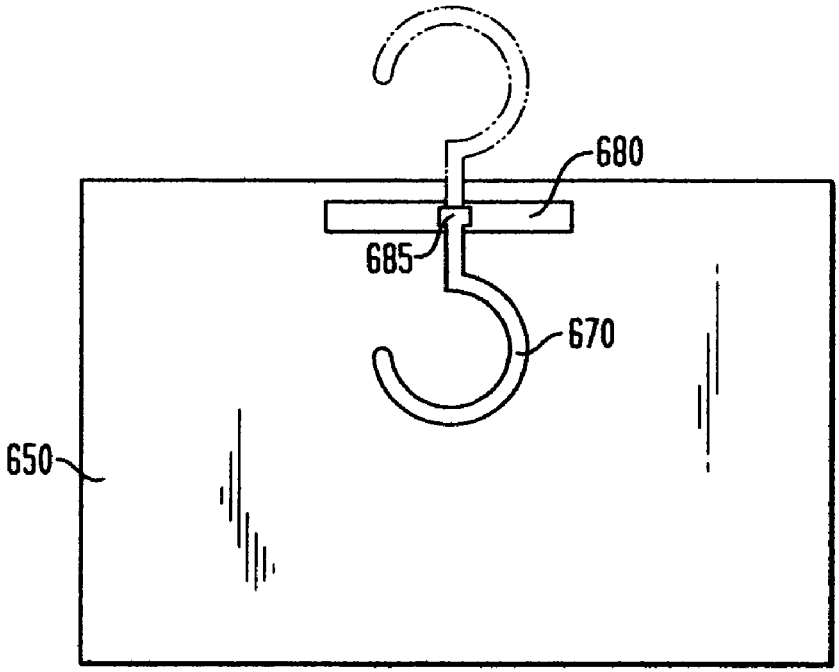
FIG. 36 is a front view of a product having a rotating hook in accordance with the invention.
Figure 37:
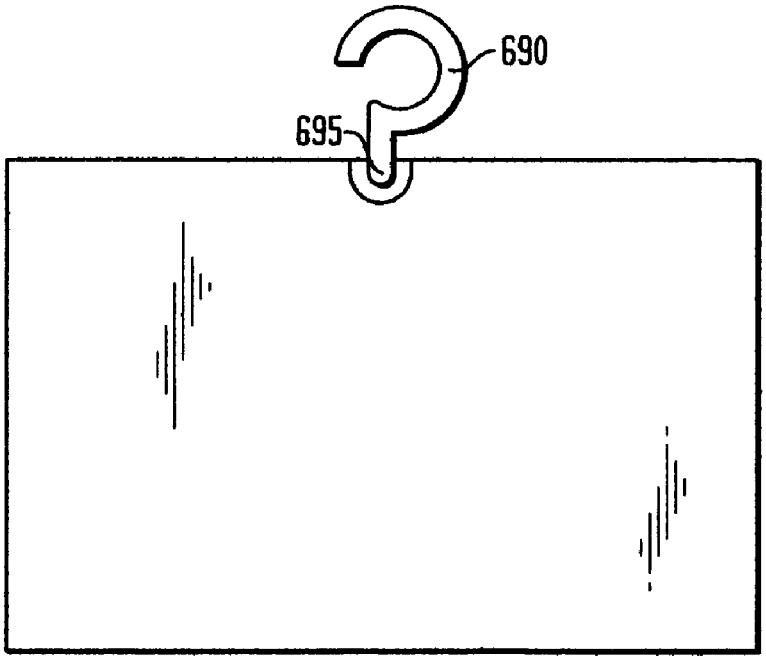
FIG. 37 is a front view of a second embodiment of a rotating hook in accordance with the invention.

Further configurations of a rotating hook 670 can likewise be provided to the product. For comparison, two alternate embodiments are shown in FIG. 36 (corresponding to FIG. 1) and FIG. 37. If desired, the hook can rotate into and out of the plane of the product as shown in FIG. 36. The hook is located in a pocket 680, which has an opening 685, allowing the hook to rotate upward and downward. Alternatively, the hook 690 can be attached to a pivot 695 as shown in FIG. 37, allowing the hook to rotate clockwise (or counterclockwise) in the plane of the product.

In one embodiment of the invention, the hook is not visible from the outside of the garment when the garment is being worn. In this embodiment, the hook is located between the garment and the skin, or between the garment and another layer of clothing (whether between two layers of clothing that are part of the same garment or between the garment and a second layer of clothing under that garment). In an alternate embodiment, the hook can rest on the outer surface of the garment, and could be made to look stylish or fashionable. For example, the back of the garment can have a hook on it, e.g. a flat hook of the same or different color than the garment. This external hook would, therefore, serve both as a utilitarian device and also, potentially, as a fashion statement.

Figure 28:
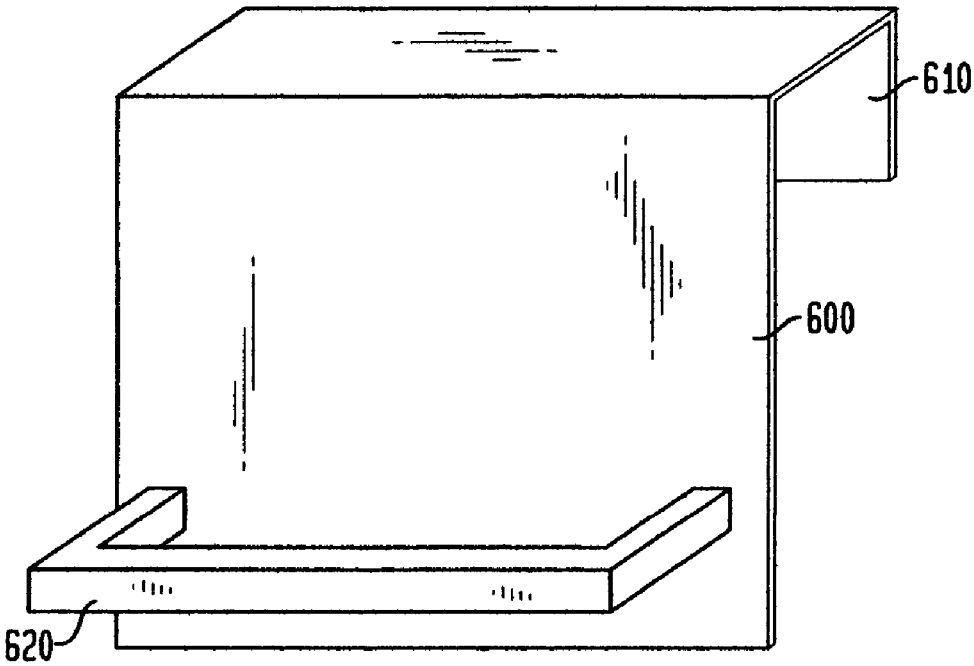
FIG. 28 is a perspective view of a universal adapter in accordance with a further embodiment of the present invention.

In an additional embodiment of the invention, an adapter 600 is provided as shown in FIG. 28. This adapter attaches over a item such as a door, drawer, or so forth by inserting the extension 610 over an upper edge of that door or drawer. For those items which, unlike a door or drawer, do not have a top flange, the adapter can be provided without the extension 610, and can be attached to the item by screwing, gluing, nailing or so forth. Or, the adapter can be attached to a peg board if there are mating rods extending from the adapter.

Adapter 600 includes a rod or bar 620. In this manner, any door or drawer can be quickly adapted to provide a rod or series of hooks thereon for suspending the garments of the present invention. As an alternative to a rod or bar, one or more hooks can be provided.

Although the present inventions have been described in many of the embodiments using clothing as an illustration, it is to be understood that they may be used with any of the products of the related applications listed above, the contents of which are incorporated herein by reference. Likewise, although they have been described with reference to hanging the products on a rod, it will be apparent that they can also be used to hang the products on hooks, handles, and so forth.

Having described this invention with regard to specific embodiments, it is to be understood that the description is not meant as a limitation since further modifications and variations may be apparent or may suggest themselves. It is intended that the present application cover all such modifications and variations.

What is claimed is:

1. A method, comprising:

providing a flap of material for use as part of an article of clothing for hanging the clothing on a mounted rod without the use of a hanger;

said flap comprising a fastener for attaching said clothing to the mounted rod without removing the rod from its supports, said fastener comprising a ring, said ring being integrated into said material of said flap, said ring comprising an opening, said opening comprising an open configuration and a closed configuration, wherein said ring can be inserted onto a rod when said opening is in said open configuration to hang said clothing from the rod.

2. A method as claimed in claim 1, wherein said opening is a slit.

3. A method as claimed in claim 2, wherein said slit is an offset slit.

4. A method as claimed in claim 2, wherein said slit is a vertical slit.

5. A method as claimed in claim 2, wherein said slit is curved.

6. A method as claimed in claim 2, wherein said slit is a closed slit.

7. A method as claimed in claim 2, wherein said slit is an open slit.

8. A method as claimed in claim 2, wherein said flap of said clothing comprises an edge when said clothing is hanging from the rod, and wherein said slit intersects with said edge of said flap.

9. A method as claimed in claim 1, wherein said fastener can also be used to hang said clothing from a hook.

10. A method as claimed in claim 1, wherein said opening is sufficiently large when said opening is in said open configuration such that the mounted rod can be passed through said opening to suspend said clothing on the rod, and wherein the mounted rod cannot be passed through said opening when said opening is in said closed configuration.

11. A method as claimed in claim 1, wherein said opening is a slit, said slit comprising a left edge and a right edge, said open configuration being a configuration in which said ring is flexed so that said left edge and said right edge of said slit are sufficiently far apart such that said ring can be inserted onto the rod by inserting the rod between said left edge and said right edge, and wherein said closed configuration is a configuration wherein said left edge and said right edge are sufficiently close together such that the rod does not pass between said left edge and said right edge.

12. A method as claimed in claim 1, wherein said fastener comprises a sliding member which is used to place said opening in said open configuration or said closed configuration.

13. A method as claimed in claim 1, wherein said fastener comprises a pivoting member which is used to place said opening in said open configuration or said closed configuration.

14. A method as claimed in claim 1, wherein said fastener comprises a pin and a channel, and wherein said pin is inserted into said channel when said opening is in said closed configuration.

15. A method as claimed in claim 11, wherein said fastener further comprises extensions for facilitating flexing of said ring to move said left edge and said right edge of said slit apart.

16. A method as claimed in claim 1, wherein said flap is removably attachable to said clothing.

17. A method as claimed in claim 16, wherein said flap is permanently attached to said clothing.

18. A method as claimed in claim 1, wherein said clothing is outerwear.

19. A method as claimed in claim 1, wherein said clothing is a shirt.

20. A method as claimed in claim 1, wherein said clothing is pants.

21. A method as claimed in claim 1, wherein said clothing is an apron.

22. A method as claimed in claim 1, wherein said clothing is an oven mitt.

23. A method, comprising:

providing a flap of material for use as part of an article of clothing for hanging the clothing without the use of a hanger;

said flap comprising a fastener for hanging said clothing;

said fastener comprising a ring, said ring comprising a slit, said ring being integrated into said material of said flap;

said slit of said ring comprising a left edge and a right edge, said ring being suitable for hanging on a rod or on another support and wherein, when said ring is used for hanging the clothing on a rod, the rod can be passed between said left edge and said right edge to insert said ring onto the rod and suspend said clothing from the rod.

24. An article of manufacture, comprising:

an article of clothing for hanging without the use of a hanger;

wherein said clothing comprises a flap of material, said flap comprising a fastener for hanging said clothing;

said fastener comprising a ring, said ring being integrated into said material of said flap, said ring comprising an opening, said opening comprising an open configuration and a closed configuration;

wherein said fastener can be inserted onto a rod when said opening is in said open configuration, and wherein said fastener is secured to the rod to hang said clothing from the rod when said fastener is in said closed configuration.

25. An article as claimed in claim 24, wherein said opening of said ring overlaps said material of said flap.

26. An article as claimed in claim 24, wherein said opening is a slit.

27. An article as claimed in claim 26, wherein said slit is an offset slit.

28. An article as claimed in claim 26, wherein said slit is a vertical slit.

29. An article as claimed in claim 26, wherein said slit is curved.

30. An article as claimed in claim 26, wherein said slit is a closed slit.

31. An article as claimed in claim 26, wherein said slit is an open slit.

32. An article as claimed in claim 26, wherein said flap of said clothing comprises an edge when said clothing is hanging from the rod, and wherein said slit intersects with said edge of said flap.

33. An article as claimed in claim 24, wherein said fastener can also be used to hang said clothing from a hook.

34. An article as claimed in claim 24, wherein said opening is sufficiently large when said opening is in said open configuration such that the mounted rod can be passed through said opening to suspend said clothing on the rod, and wherein the mounted rod cannot be passed through said opening when said opening is in said closed configuration.

35. An article as claimed in claim 24, wherein said opening is a slit, said slit comprising a left edge and a right edge, said open configuration being a configuration in which said ring is flexed so that said left edge and said right edge of said slit are sufficiently far apart such that said ring can be inserted onto the rod by inserting the rod between said left edge and said right edge, and wherein said closed configuration is a configuration wherein said left edge and said right edge are sufficiently close together such that the rod does not pass between said left edge and said right edge.

36. An article as claimed in claim 24, wherein said fastener comprises a sliding member which is used to place said opening in said open configuration or said closed configuration.

37. An article as claimed in claim 24, wherein said fastener comprises a pivoting member which is used to place said opening in said open configuration or said closed configuration.

38. An article as claimed in claim 24, wherein said fastener comprises a pin and a channel, and wherein said pin is inserted into said channel when said opening is in said closed configuration.

39. An article as claimed in claim 35, wherein said fastener further comprises extensions for facilitating flexing of said ring to move said left edge and said right edge of said slit apart.

40. An article as claimed in claim 24, wherein said flap is removably attached to said clothing.

41. An article as claimed in claim 24, wherein said flap is permanently attached to said clothing.

42. An article as claimed in claim 24, wherein said clothing is outerwear.

43. An article as claimed in claim 24, wherein said clothing is a shirt.

44. An article as claimed in claim 24, wherein said clothing is pants.

45. An article as claimed in claim 24, wherein said clothing is an apron.

46. An article as claimed in claim 24, wherein said clothing is an oven mitt.

47. A method as claimed in claim 1, wherein said opening of said ring overlaps said material of said flap.

48. A method as claimed in claim 23, wherein said opening of said ring overlaps said material of said flap.

* * * * *